US005579432A

United States Patent [19]

Wigren

[11] Patent Number: 5,579,432

[45] Date of Patent: Nov. 26, 1996

[54] DISCRIMINATING BETWEEN STATIONARY AND NON-STATIONARY SIGNALS

[75] Inventor: Karl T. Wigren, Uppsala, Sweden

[73] Assignee: Telefonaktiebolaget LM Ericsson, Stockholm, Sweden

[21] Appl. No.: 248,714

[22] Filed: May 25, 1994

[30] Foreign Application Priority Data

May 26, 1993 [SE] Sweden ..... 9301798

[51] Int. Cl.[6] ..... G10L 3/02

[52] U.S. Cl. ..... 395/2.23; 395/2.35

[58] Field of Search ..... 381/46, 47; 395/2, 395/2.2, 2.24, 2.23, 2.35–2.37, 2.42, 2.43

[56] References Cited

U.S. PATENT DOCUMENTS

| | | | |
|---|---|---|---|
| 4,544,919 | 10/1985 | Gerson | 381/41 |
| 4,672,669 | 6/1987 | DesBlache et al. | 381/46 |
| 5,255,340 | 10/1993 | Arnaud et al. | 395/2 |
| 5,276,765 | 1/1994 | Freeman et al. | 395/2 |
| 5,459,814 | 10/1995 | Gupta et al. | 395/2.42 |

FOREIGN PATENT DOCUMENTS

| | | | |
|---|---|---|---|
| 335521 | 10/1989 | European Pat. Off. | G10L 3/00 |
| 522213 | 1/1993 | European Pat. Off. | G10L 3/00 |
| 2137791 | 10/1984 | United Kingdom | G10L 1/00 |
| WO94/17515 | 8/1994 | WIPO | G10L 3/00 |

OTHER PUBLICATIONS

"Voice Activity Detection", GSM–recommendation 06.32, ETSI–PT 12.

Adoul et al., "A Comparison of Some Algebraic Structures for CELP Coding of Speech", Proc. International Conference on Acoustics, Speech and Signal Processing, pp. 1953–1956 (1987).

Atal et al., "Advances in Speech Coding", Kluwer Academic Publishers, pp. 69–79 (1991).

Campbell et al., "The DoD4.8 KBPS Standard (Proposed Federal Standard 1016)", Kluwer Academic Publishers, pp. 121–134 (1991).

LeRoux et al., "A Fixed Point Computation of Partial Correlation Coefficients", vol. ASSP–26, No. 3, pp. 257–259 (1977).

Rabiner et al., "Digital Processing of Speech Signals", CHapter 8, Prentice–Hall, 1978.

Salami, "Binary Pulse Excitation: A Novel Approach to Low Complexity CELP Coding", Kluwer Academic Publishers, pp. 145–156 (1991).

Strobach, "New Forms of Levinson and Schur Algorithms", IEEE SP Magazine, pp. 12–36 (Jan. 1991).

*Primary Examiner*—Kee Mei Tung

*Attorney, Agent, or Firm*—Burns, Doane, Swecker & Mathis, L.L.P.

[57] ABSTRACT

A discriminator discriminates between stationary and non-stationary signals. The energy $E(T_i)$ of the input signal is calculated in a number of windows $T_i$. These energy values are stored in a buffer, and from these stored values a test variable $V_T$ is calculated. This test variable comprises the ratio between the maximum energy value and the minimum energy value in the buffer. Finally, the test variable is tested against a stationarity limit $\gamma$. If the test variable exceeds this limit the input signal is considered non-stationary. This discrimination is especially useful for discriminating between stationary and non-stationary background sounds in a mobile radio communication system.

26 Claims, 2 Drawing Sheets

DISCRIMINATING BETWEEN STATIONARY AND NON-STATIONARY SIGNALS

TECHNICAL FIELD

The present invention relates to a method of discriminating between stationary and non-stationary signals. This method can for instance be used to detect whether a signal representing background sounds in a mobile radio communication system is stationary. The invention also relates to a method and an apparatus using this method for detecting and encoding/decoding stationary background sounds.

BACKGROUND OF THE INVENTION

Many modern speech coders belong to a large class of speech coders known as LPC (Linear Predictive Coders). Examples of coders belonging to this class are: the 4,8 Kbit/s CELP from the US Department of Defense, the RPE-LTP coder of the European digital cellular mobile telephone system GSM, the VSELP coder of the corresponding American system ADC, as well as the VSELP coder of the pacific digital cellular system PDC.

These coders all utilize a source-filter concept in the signal generation process. The filter is used to model the short-time spectrum of the signal that is to be reproduced, whereas the source is assumed to handle all other signal variations.

A common feature of these source-filter models is that the signal to be reproduced is represented by parameters defining the output signal of the source and filter parameters defining the filter. The term "linear predictive" refers to the method generally used for estimating the filter parameters. Thus, the signal to be reproduced is partially represented by a set of filter parameters.

The method of utilizing a source-filter combination as a signal model has proven to work relatively well for speech signals.

However, when the user of a mobile telephone is silent and the input signal comprises the surrounding sounds, the presently known coders have difficulties to cope with this situation, since they are optimized for speech signals. A listener on the other side of the communication link may easily get annoyed when familiar background sounds cannot be recognized since they have been "mistreated" by the coder.

According to Swedish patent application 93 00290-5, which is hereby incorporated by reference, this problem is solved by detecting the presence of background sounds in the signal received by the coder and modifying the calculation of the filter parameters in accordance with a certain so called anti-swirling algorithm if the signal is dominated by background sounds.

However, it has been found that different background sounds may not have the same statistical character. One type of background sound, such as car noise, can be characterized as stationary. Another type, such as background babble, can be characterized as being non-stationary. Experiments have shown that the mentioned anti-swirling algorithm works well for stationary but not for non-stationary background sounds. Therefore it would be desirable to discriminate between stationary and non-stationary background sounds, so that the anti-swirling algorithm can be by-passed if the background sound is non-stationary.

SUMMARY OF THE INVENTION

Thus, an object of the present invention is a method of discriminating between stationary and non-stationary signals, such as signals representing background sounds in a mobile radio communication system.

In accordance with the invention such a method comprises:

(a) estimating one of the statistical moments of a signal in each of N time sub windows $T_i$, where N>2, of a time window T of predetermined length;

(b) estimating the variation of the estimates obtained in step (a) as a measure of the stationarity of said signal; and (c) determining whether the estimated variation obtained in step (b) exceeds a predetermined stationarity limit $\gamma$.

Another object of the present invention is a method of detecting and encoding and/or decoding stationary background sounds in a digital frame based speech encoder and/or decoder including a signal source connected to a filter, said filter being defined by a set of filter parameters for each frame, for reproducing the signal that is to be encoded and/or decoded.

According to the present invention such a method comprises the steps of:

(a) detecting whether the signal that is directed to said encoder/decoder represents primarily speech or background sounds;

(b) when said signal directed to said encoder/decoder represents primarily background sounds, detecting whether said background sound is stationary; and (c) when said signal is stationary, restricting the temporal variation between consecutive frames and/or the domain of at least some filter parameters in said set.

A further object of the present invention is an apparatus for encoding and/or decoding stationary background sounds in a digital frame based speech coder and/or decoder including a signal source connected to a filter, said filter being defined by a set of filter parameters for each frame, for reproducing the signal that is to be encoded and/or decoded.

According to the present invention this apparatus comprises:

(a) means for detecting whether the signal that is directed to said encoder/decoder represents primarily speech or background sounds;

(b) means for detecting, when said signal directed to said encoder/decoder represents primarily background sounds, whether said background sound is stationary; and (c) means for restricting the temporal variation between consecutive frames and/or the domain of at least some filter parameters in said set when said signal directed to said encoder/decoder represents stationary background sounds.

BRIEF DESCRIPTION OF THE DRAWINGS

The invention, together with further objects and advantages thereof, may best be understood by making reference to the following description taken together with the accompanying drawings, in which.

DETAILED DESCRIPTION OF THE PREFERRED EMBODIMENTS

Although the present invention can be generally used to discriminate between stationary and non-stationary signals, the invention will be described with reference to detection of stationarity of signals that represent background sounds in a mobile radio communication system.

Figure 1:
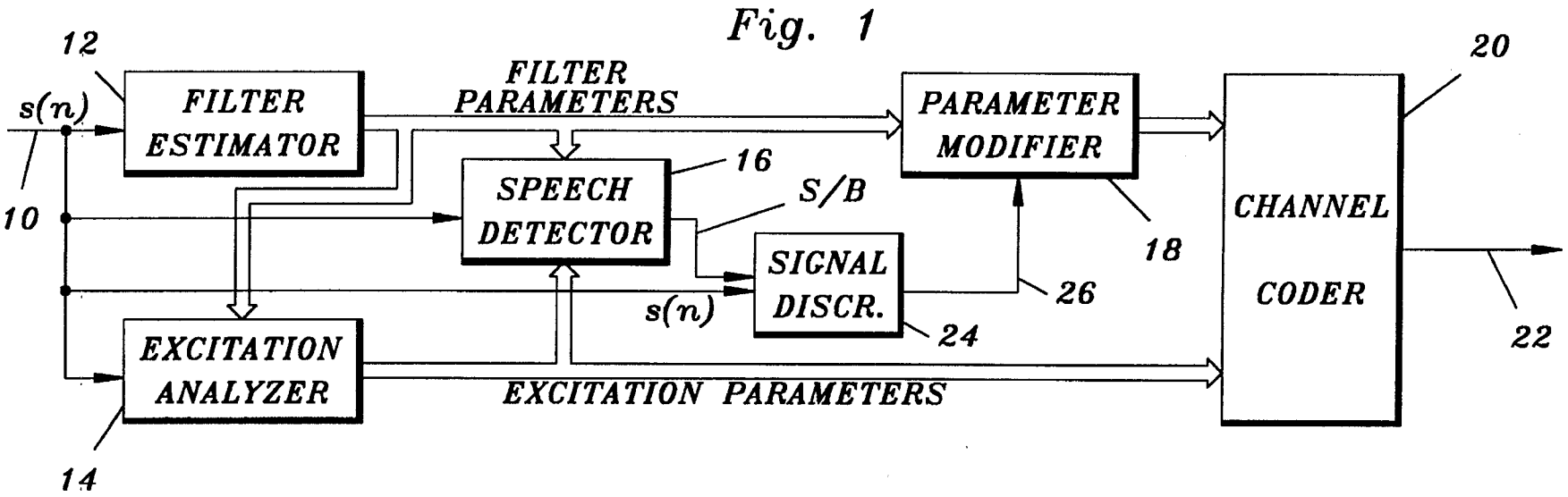
FIG. 1 is a block diagram of a speech encoder provided with means for performing the method in accordance with the present invention.

Referring to the speech coder of FIG. 1, on an input line 10 an input signal s(n) is forwarded to a filter estimator 12, which estimates the filter parameters in accordance with standardized procedures (Levinson-Durbin algorithm, the Burg algorithm, Cholesky decomposition (Rabiner, Schafer: "Digital Processing of Speech Signals", Chapter 8, Prentice-Hall, 1978), the Schur algorithm (Strobach: "New Forms of Levinson and Schur Algorithms", IEEE SP Magazine, Jan 1991, pp 12–36), the Le RouxGueguen algorithm (Le Roux, Gueguen: "A Fixed Point Computation of Partial Correlation Coefficients", IEEE Transactions of Acoustics, "Speech and Signal Processing", Vol ASSP-26, No 3, pp 257–259, 1977), the so called FLAT-algorithm described in U.S. Pat. No. 4,544,919 assigned to Motorola Inc.). The filter estimator 12 outputs the filter parameters for each frame. These filter parameters are forwarded to an excitation analyzer 14, which also receives the input signal on line 10. The excitation analyzer 14 determines the best source or excitation parameters in accordance with standard procedures. Examples of such procedures are VSELP (Gerson, Jasiuk: "Vector Sum Excited Linear Prediction (VSELP)", in Atal et al, eds, "Advances in Speech Coding", Kluwer Academic Publishers, 1991, pp 69–79), TBPE (Salami, "Binary Pulse Excitation: A Novel Approach to Low Complexity CELP Coding", pp 145–156 of previous reference), Stochastic Code Book (Campbell et al: "The DoD4.8 KBPS Standard (Proposed Federal Standard 1016)", pp 121–134 of previous reference), ACELP (Adoul, Lamblin: "A Comparison of Some Algebraic Structures for CELP Coding of Speech", Proc. International Conference on Acoustics, Speech and Signal Processing 1987, pp 1953–1956) These excitation parameters, the filter parameters and the input signal on line 10 are forwarded to a speech detector 16. This detector 16 determines whether the input signal comprises primarily speech or background sounds. A possible detector is for instance the voice activity detector defined in the GSM system (Voice Activity Detection, GSM-recommendation 06.32, ETSI/PT 12). A suitable detector is described in EP,A,335 521 (BRITISH TELECOM PLC). Speech detector 16 produces an output signal S/B indicating whether the coder input signal contains primarily speech or not. This output signal together with the filter parameters is forwarded to a parameter modifier 18 over signal discriminator 24.

In accordance with the above Swedish patent application parameter modifier 18 modifies the determined filter parameters in the case where there is no speech signal present in the input signal to the encoder. If a speech signal is present the filter parameters pass through parameter modifier 18 without change. The possibly changed filter parameters and the excitation parameters are forwarded to a channel coder 20, which produces the bit-stream that is sent over the channel on line 22.

The parameter modification by parameter modifier 18 can be performed in several ways.

One possible modification is a bandwidth expansion of the filter. This means that the poles of the filter are moved towards the origin of the complex plane. Assume that the original filter H(z)=1/A(z) is given by the expression $$A(z) = 1 + \sum_{m=1}^{M} a_m z^{-m}$$

When the poles are moved with a factor r, $0 \leqq r \leqq 1$, the bandwidth expanded version is defined by A(z/r), or:

$$A\left(\frac{z}{r}\right) = 1 + \sum_{m=1}^{M} (a_m r^m) z^{-m}$$

Another possible modification is low-pass filtering of the filter parameters in the temporal domain. That is, rapid variations of the filter parameters from frame to frame are attenuated by low-pass filtering at least some of said parameters. A special case of this method is averaging of the filter parameters over several frames, for instance 4–5 frames.

The parameter modifier 18 can also use a combination of these two methods, for instance perform a bandwidth expansion followed by low-pass filtering. It is also possible to start with low-pass filtering and then add the bandwidth expansion.

In the above description, the signal discriminator 24 has been ignored. However, it has been found that it is not sufficient to divide signals into signals representing speech and background sounds, since the background sounds may not have the same statistical character, as explained above. Thus, the signals representing background sounds are divided into stationary and non-stationary signals in signal discriminator 24, which will be further described with reference to FIGS. 3 and 4. Thus, the output signal on line 26 from signal discriminator 24 indicates whether the frame to be coded contains stationary background sounds, in which case parameter modifier 18 performs the above parameter modification, or speech/non-stationary background sounds, in which case no modification is performed.

In the above explanation, it has been assumed that the parameter modification is performed in the coder in the transmitter. However, it is appreciated that a similar procedure can also be performed in the decoder of the receiver. This is illustrated by the embodiment shown in FIG. 2.

Figure 2:
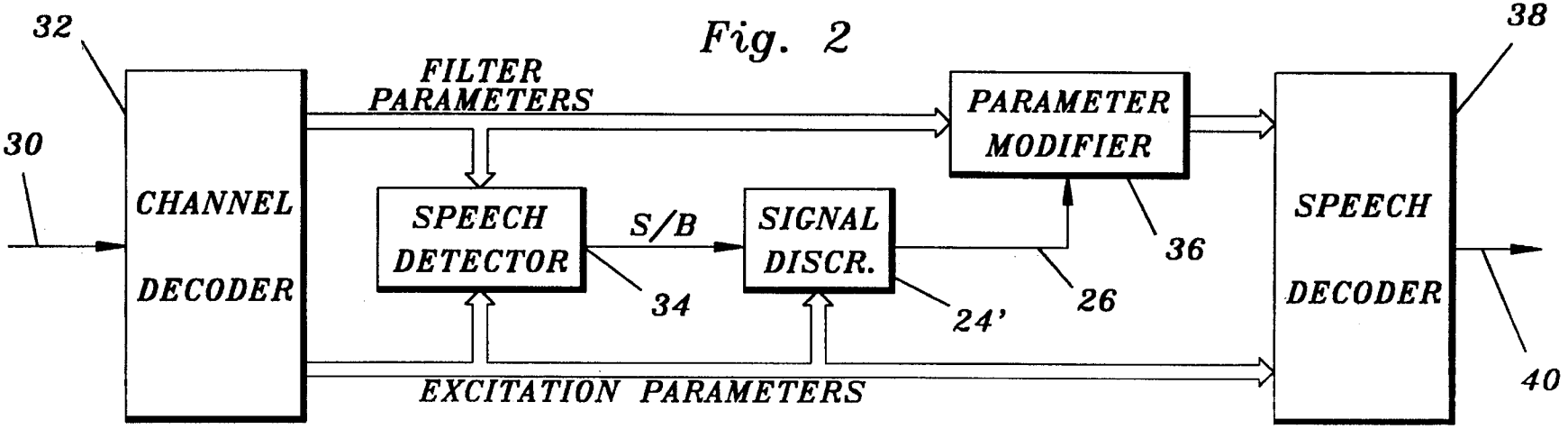
FIG. 2 is a block diagram of a speech decoder provided with means for performing the method in accordance with the present invention.

In FIG. 2, a bit-stream from the channel is received on input line 30. This bit-stream is decoded by a channel decoder 32. The channel decoder 32 outputs filter parameters and excitation parameters. In this case it is assumed that these parameters have not been modified in the coder of the transmitter. The filter and excitation parameters are forwarded to a speech detector 34, which analyzes these parameters to determine whether the signal that would be reproduced by these parameters contains a speech signal or not. The output signal S/B of speech detector 34 is over signal discriminator 24' forwarded to a parameter modifier 36, which also receives the filter parameters.

In accordance with the above Swedish patent application, if speech detector 34 has determined that there is no speech signal present in the received signal, parameter modifier 36 performs a modification similar to the modification performed by parameter modifier 18 of FIG. 1. If a speech signal is present, no modification occurs. The possibly modified filter parameters and the excitation parameters are forwarded to a speech decoder 38, which produces a synthetic output signal on line 40. The speech decoder 38 uses the excitation parameters to generate the above mentioned source signals and the possibly modified filter parameters to define the filter in the source-filter model.

As in the coder 20 of FIG. 1, the signal discriminator 24' of FIG. 2 discriminates between stationary and non-stationary background sounds. Thus, only frames containing stationary background sounds will activate the parameter modifier 36. However, in this case the signal discriminator 24' does not have access to the speech signal s(n) itself, but only to the excitation parameters that define that signal. The discrimination process will be further described with reference to FIGS. 3 and 4.

Figure 3:
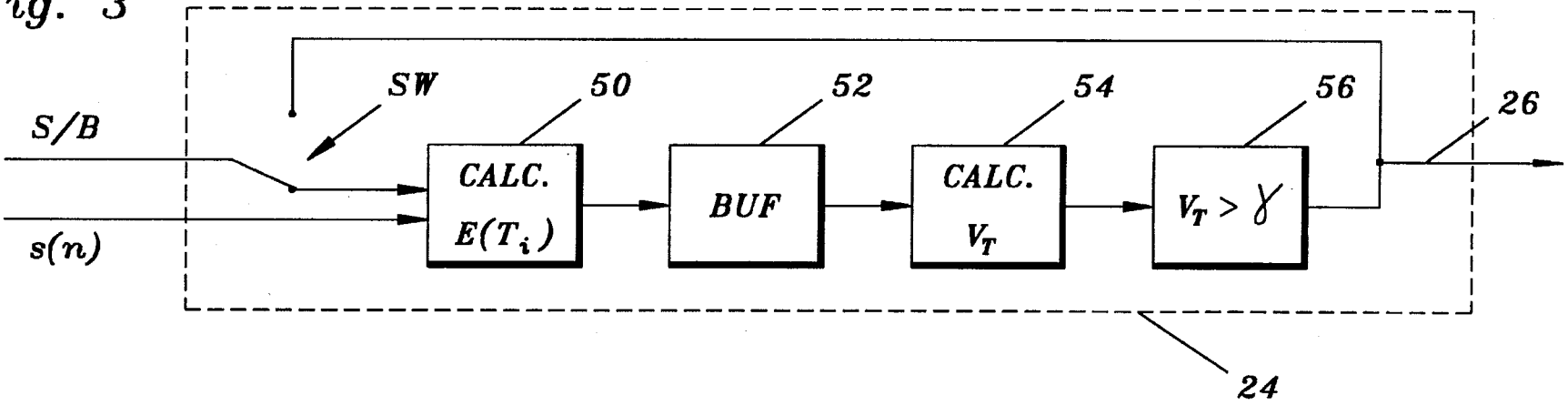
FIG. 3 is a block diagram of a signal discriminator that can be used in the speech encoder of FIG. 1.

FIG. 3 shows a block diagram of the signal discriminator 24 of FIG. 1. The discriminator 24 receives the input signal s(n) and the output signal S/B from the speech detector 16. Signal S/B is forwarded to a switch SW. If the speech detector 16 has determined that signal s(n) contains primarily speech, switch SW will assume the upper position, in which case signal S/B is forwarded directly to the output of the discriminator 24.

If signal s(n) contains primarily background sounds switch SW is in its lower position, and signals S/B and s (n) are both forwarded to a calculator means 50, which estimates the energy $E(T_i)$ of each frame. Here $T_i$ may denote the time span of frame i. However, in a preferred embodiment, $T_i$ contains the samples of two consecutive frames and $E(T_i)$ denotes the total energy of these frames. In this preferred embodiment, next window $T_{i+1}$is shifted one speech frame, so that it contains one new frame and one frame from the previous window $T_i$. Thus, the windows overlap one frame. The energy can for instance be estimated in accordance with the formula:

$$E(T_i) = \sum_{t_n \in T_i} s(n)^2$$

where s(n)=s(tn).

The energy estimates $E(T_i)$ are stored in a buffer 52. This buffer can for instance contain 100–200 energy estimates from 100–200 frames. When a new estimate enters the buffer 52 the oldest estimate is deleted from the buffer. Thus, the buffer 52 always contains the N last energy estimates, where N is the size of the buffer.

Next the energy estimates of the buffer 52 are forwarded to a calculator means 54, which calculates a test variable $V_T$ in accordance with the formula:

$$V_T = \frac{\max_{T_i \in T} E(T_i)}{\min_{T_i \in T} E(T_i)}$$

where T is the accumulated time span of all the (possibly overlapping) time windows $T_i$. T usually is of fixed length, for example 100–200 speech frames or 2–4 seconds. In words, $V_T$ is the maximum energy estimate in time period T divided by the minimum energy estimate within the same period. This test variable $V_T$ is an estimate of the variation of the energy within the last N frames. This estimate is later used to determine the stationarity of the signal. If the signal is stationary its energy will vary very little from frame to frame, which means that the test variable $V_T$ will be close to 1. For a non-stationary signal the energy will vary considerably from frame to frame, which means that the estimate will be considerably greater than 1.

Test variable $V_T$ is forwarded to a comparator 56, in which it is compared to a stationary limit γ. If $V_T$ exceeds γ a non-stationary signal is indicated on output line 26. This indicates that the filter parameters should not be modified. A suitable value for γ has been found to be 2–5, especially 3–4.

From the above description it is clear that to detect whether a frame contains speech it is only necessary to consider that particular frame, which is done in the speech detector 16. However, if it is determined that the frame does not contain speech, it will be necessary to accumulate energy estimates from frames surrounding that frame in order to make a stationarity discrimination. Thus, a buffer with N storage positions, where N>2 and usually of the order of 100–200, is needed. This buffer may also store a frame number for each energy estimate.

When test variable $V_T$ has been tested and a decision has been made in the comparator 56, the next energy estimate is produced in a calculator means 50 and shifted into a buffer 52, whereafter a new test variable $V_T$ is calculated and compared to γ in comparator 56. In this way time window T is shifted one frame forward in time.

In the above description, it has been assumed that when the speech detector 16 has detected a frame containing background sounds, it will continue to detect background sounds in the following frames in order to accumulate enough energy estimates in the buffer 52 to form a test variable $V_T$. However, there are situations in which the speech detector 16 might detect a few frames containing background sounds and then some frames containing speech, followed by frames containing new background sounds. For this reason, the buffer 52 stores energy values in "effective time", which means that energy values are only calculated and stored for frames containing background sounds. This is also the reason why each energy estimate may be stored with its corresponding frame number, since this gives a mechanism to determine that an energy value is too old to be relevant when there have been no background sounds for a long time.

Another situation that can occur is when there is a short period of background sounds, which results in few calculated energy values, and there are no more background sounds within a very long period of time. In this case, the buffer 52 may not contain enough energy values for a valid test variable calculation within a reasonable time. The solution for such cases is to set a time out limit, after which it is decided that these frames containing background sounds should be treated as speech, since there is not enough basis for a stationarity decision.

Furthermore, in some situations when it has been determined that a certain frame contains non-stationary background sounds, it is preferable to lower the stationarity limit γ from, for example, 3.5 to 3.3 to prevent decisions for later frames from switching back and forth between "stationary" and "non-stationary". Thus, if a non-stationary frame has been found it will be easier for the following frames to be classified as non-stationary as well. When a stationary frame eventually is found, the stationarity limit γ is raised again. This technique is called "hysteresis".

Another preferable technique is "hangover". Hangover means that a certain decision by the signal discriminator 24 has to persist for at least a certain number of frames, for example, 5 frames, to become final. Preferably "hysteresis" and "hangover" are combined.

Figure 4:
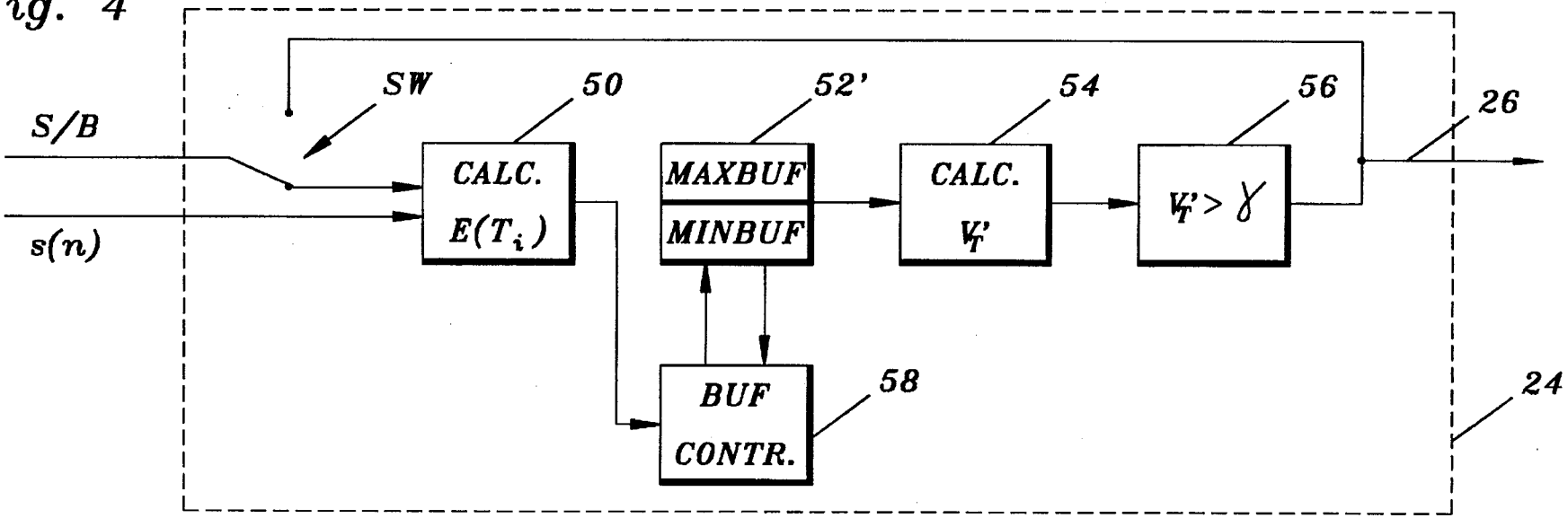
FIG. 4 is a block diagram of a preferred signal discriminator that can be used in the speech encoder of FIG. 1.

From the above it is clear that the embodiment of FIG. 3 requires a buffer 52 of considerable size, 100–200 memory positions in a typical case (200–400 if the frame number is also stored). Since this buffer usually resides in a signal processor, where memory resources are very scarce, it would be desirable to reduce the buffer size. FIG. 4 therefore shows a preferred embodiment of the signal discriminator 24, in which the use of a buffer has been modified by a buffer controller 58 controlling a buffer 52'.

The purpose of a buffer controller 58 is to manage the buffer 52' in such a way that unnecessary energy estimates $E(T_i)$ are not stored. This approach is based on the observation that only the most extreme energy estimates are actually relevant for computing $V_T$. Therefore it should be a good approximation to store only a few large and a few small energy estimates in the buffer 52'. The buffer 52' is therefore divided into two buffers, MAXBUF and MINBUF. Since old energy estimates should disappear from the buffers after a certain time, it is also necessary to store the frame numbers of the corresponding energy values in MAXBUF and MINBUF. One possible algorithm for storing values in the buffer 52' performed by the buffer controller 58 is described in detail in the Pascal program in the attached appendix.

The embodiment of FIG. 4 is suboptimal as compared to the embodiment of FIG. 3. The reason is that large frame energies may not be able to enter MAXBUF when larger, but older frame energies reside there. In this case that particular frame energy is lost even though it could have been in effect later when the previous large (but old) frame energies have been shifted out. Thus what is calculated in practice is not $V_T$ but $V'_T$ defined as:

$$V'_T = \frac{\max\limits_{T_i \in \mathrm{MAXBUF}} E(T_i)}{\min\limits_{T_i \in \mathrm{MINBUF}} E(T_i)}$$

However, from a practical point of view this embodiment is "good enough" and allows a drastic reduction of the required buffer size from 100–200 stored energy estimates to approximately 10 estimates (5 for MAXBUF and 5 for MINBUF).

As mentioned in connection with the description of FIG. 2 above, the signal discriminator 24' does not have access to signal s(n). However, since either the filter or excitation parameters usually contain a parameter that represents the frame energy, the energy estimate can be obtained from this parameter. Thus, according to the U.S. standard IS-54 the frame energy is represented by an excitaion parameter r(0). (It would of course also be possible to use r(0) in the signal discriminator 24 of FIG. 1 as an energy estimate.) Another approach would be to move the signal discriminator 24' and the parameter modifier 36 to the right of the speech decoder 38 in FIG. 2. In this way, the signal discriminator 24' would have access to signal 40, which represents the decoded signal, i.e., it is in the same form as signal s(n) in FIG. 1. This approach, however, would require another speech decoder after the parameter modifier 36 to reproduce the modified signal.

In the above description of the signal discriminator 24, 24' it has been assumed that the stationarity decisions are based on energy calculations. However, energy is only one of statistical moments of different orders that can be used for stationarity detection. Thus, it is within the scope of the present invention to use other statistical moments than the moment of second order (which corresponds to the energy or variance of the signal). It is also possible to test several statistical moments of different orders for stationarity and to base a final stationarity decision on the results from these tests.

Furthermore, the defined test variable $V_T$ is not the only possible test variable. Another test variable could, for example, be defined as:

$$V_T = \max_{T_i \in T} \left( \left| < \frac{dE(T_i)}{dt} > \right| \right)$$

where the expression $<dE(T_i)/dt>$ is an estimate of the rate of change of the energy from frame to frame. For example, a Kalman filter may be applied to compute the estimates in the formula, for example according to a linear trend model (see A. Gelb, "Applied optimal estimation", MIT Press, 1988). However, test variable $V_T$ as defined earlier in this specification has the desirable feature of being scale factor independent, which makes the signal discriminator unsensitive to the level of the background sounds.

It will be understood by those skilled in the art that various modifications and changes may be made to the present invention without departure from the spirit and scope thereof, which is defined by the appended claims.

APPENDIX

```
PROCEDURE FLstatDet(
        ZFLacf          : realAcfVectorType;  { In     }
        ZFLsp           : Boolean;            { In     }
        ZFLnrMinFrames  : Integer;            { In     }
        ZFLnrFrames     : Integer;            { In     }
        ZFLmaxThresh    : Real;               { In     }
        ZFLminThresh    : Real;               { In     }
    VAR ZFLpowOld       : Real;               { In/Out }
    VAR ZFLnrSaved      : Integer;            { In/Out }
    VAR ZFLmaxBuf       : realStatBufType;    { In/Out }
    VAR ZFLmaxTime      : integerStatBufType; { In/Out }
    VAR ZFLminBuf       : realStatBufType;    { In/Out }
    VAR ZFLminTime      : integerStatBufType; { In/Out }
    VAR ZFLprelNoStat   : Boolean);           { In/Out }

    VAR
        i                                : Integer;
        maximum,minimum                  : Real;
        powNow,testVar                   : Real;
        oldNoStat                        : Boolean;
        replaceNr                        : Integer;

  LABEL
        statEnd;

BEGIN
  oldNoStat := ZFLprelNoStat;
  ZFLprelNoStat := ZFLsp;

  IF NOT ZFLsp AND (ZFLacf[0] > 0) THEN BEGIN

    { If not speech }
    ZFLprelNoStat := True;

    ZFLnrSaved := ZFLnrSaved + 1;
```

```
powNow := ZFLacf[0] + ZFLpowOld;
ZFLpowOld := ZFLacf[0];

IF ZFLnrSaved < 2 THEN
  GOTO statEnd;

IF ZFLnrSaved > ZFLnrFrames THEN
  ZFLnrSaved := ZFLnrFrames;

{ Check if there is an old element in max buffer }
FOR i := 1 TO statBufferLength DO BEGIN
  ZFLmaxTime[i] := ZFLmaxTime[i] + 1;
  IF ZFLmaxTime[i] > ZFLnrFrames THEN BEGIN
    ZFLmaxBuf[i] := powNow;
    ZFLmaxTime[i] := 1;
  END;
END;

{ Check if there is an old element in min buffer }
FOR i := 1 TO statBufferLength DO BEGIN
  ZFLminTime[i] := ZFLminTime[i] + 1;
  IF ZFLminTime[i] > ZFLnrFrames THEN BEGIN
    ZFLminBuf[i] := powNow;
    ZFLminTime[i] := 1;
  END;
END;

maximum := - 1E38;
minimum := -maximum;
replaceNr := 0;

{ Check if an element in max buffer is to be substituted,
  find maximum
}
FOR i := 1 TO statBufferLength DO BEGIN
  IF powNow >= ZFLmaxBuf[i] THEN
    replaceNr := i;
```

```
    IF ZFLmaxBuf[i] >= maximum THEN
      maximum := ZFLmaxBuf[i];
  END;


  IF replaceNr > 0 THEN BEGIN
    ZFLmaxTime[replaceNr] := 1;
    ZFLmaxBuf[replaceNr] := powNow;
    IF ZFLmaxBuf[replaceNr] >= maximum THEN
      maximum := ZFLmaxBuf[replaceNr];

  END;

  replaceNr := 0;

  { Check if an element in min buffer is to be substituted,
    find minimum
  }
  FOR i := 1 TO statBufferLength DO BEGIN
    IF powNow <= ZFLminBuf[i] THEN
      replaceNr := i;

    IF ZFLminBuf[i] <= minimum THEN
      minimum := ZFLminBuf[i];

  END;

  IF replaceNr > 0 THEN BEGIN
    ZFLminTime[replaceNr] := 1;
    ZFLminBuf[replaceNr] := powNow;
    IF ZFLminBuf[replaceNr] >= minimum THEN
      minimum := ZFLminBuf[replaceNr];

  END;

  IF ZFLnrSaved >= ZFLnrMinFrames THEN BEGIN
```

```
        IF minimum > 1 THEN BEGIN

          { Calculate test variable }
          testVar := maximum/minimum;



          { If test variable is greater than maxThresh, decide
            speech
            If test variable is less than minThresh, decide
            babble
            If test variable is between, keep previous decision
          }
          ZFLprelNoStat := oldNoStat;

          IF testVar > ZFLmaxThresh THEN
            ZFLprelNoStat := True;

          IF testVar < ZFLminThresh THEN
            ZFLprelNoStat := False;

        END;
      END;
    END;
  statEnd:
  END;


  PROCEDURE FLhangHandler(
            ZFLmaxFrames      : Integer;      { In     }
            ZFLhangFrames     : Integer;      { In     }
            ZFLvad            : Boolean;      { In     }
        VAR ZFLelapsedFrames  : Integer;      { In/Out }
        VAR ZFLspHangover     : Integer;      { In/Out }
        VAR ZFLvadOld         : Boolean;      { In/Out }
        VAR ZFLsp             : Boolean);     { Out    }
```

```
BEGIN

  { Delays change of decision from speech to no speech
    hangFrames number of frames
    However, this is not done if speech has lasted less than
    maxFrames frames
  }
  ZFLsp := ZFLvad;

  IF ( ZFLelapsedFrames < ZFLmaxFrames ) THEN
    ZFLelapsedFrames := ZFLelapsedFrames + 1;

  IF ZFLvadOld AND NOT ZFLvad THEN
    ZFLspHangOver := 1;

  IF (ZFLspHangOver < ZFLhangFrames) AND NOT ZFLvad THEN BEGIN
    ZFLspHangOver := ZFLspHangOver + 1;
    ZFLsp := True;
  END;

  IF NOT ZFLvad AND ( ZFLelapsedFrames < ZFLmaxFrames ) THEN
    ZFLsp := False;

  IF NOT ZFLsp AND ( ZFLspHangOver > ZFLhangFrames-1 ) THEN
    ZFLelapsedFrames := 0;

  ZFLvadOld := ZFLvad;
END;
```

I claim:

1. A method of discriminating between stationary and non-stationary signals, such as signals representing background sounds in a mobile radio communication system, said method comprising the steps of:

(a) estimating a statistical moment of a signal in each of N time sub windows $T_i$, where N>2, of a time window T of predetermined length;

(b) estimating a variation of the estimates obtained in step (a) as a measure of the stationarity of said signal; and (c) determining whether the estimated variation obtained in step (b) exceeds a predetermined stationarity limit $\gamma$.

2. The method of claim 1, further comprising estimating the statistical moment of second order in step (a).

3. The method of claim 1, further comprising estimating an energy $E(T_i)$ of the signal in each time sub window $T_i$ in step (a).

4. The method of claim 3, wherein said signal is a discrete-time signal.

5. The method of claim 4, wherein said estimated variation is formed in accordance with the formula:

$$V_T = \frac{\max_{T_i \in T} E(T_i)}{\min_{T_i \in T} E(T_i)}$$

6. The method of claim 5, further comprising overlapping time sub windows $T_i$ collectively covering said time window T.

7. The method of claim 6, further comprising equal size time sub windows $T_i$.

8. The method of claim 7, wherein each time sub window $T_i$ comprises two consecutive speech frames.

9. The method of claim 4, wherein said estimated variation is formed in accordance with the formula:

$$V_T = \frac{\max_{T_i \in \mathrm{MAXBUF}} E(T_i)}{\min_{T_i \in \mathrm{MINBUF}} E(T_i)}$$

where MAXBUF is a buffer containing only the largest recent energy estimates and MINBUF is a buffer containing only the smallest recent energy estimates.

10. The method of claim 9, further comprising overlapping time sub windows $T_i$ collectively covering said time window T.

11. The method of claim 10, further comprising equal size time sub windows $T_i$.

12. A method of detecting and encoding and/or decoding stationary background sounds in a digital frame based speech encoder and/or decoder including a signal source connected to a filter, said filter being defined by a set of filter parameters for each frame, for reproducing the signal that is to be encoded and/or decoded, said method comprising the steps of:

(a) detecting whether the signal that is directed to said encoder/decoder represents primarily speech or background sounds;

(b) when said signal directed to said encoder/decoder represents primarily background sounds, detecting whether said background sound is stationary; and (c) when said signal is stationary, restricting a temporal variation between consecutive frames and/or the domain of at least some filter parameters in said set of filter parameter.

13. The method of claim 12, wherein said stationarity detection comprises the steps:

(b1) estimating a statistical moment of said background sounds in each of N time sub windows $T_i$, where N>2, of a time window T of predetermined length;

(b2) estimating a variation of the estimates obtained in step (b1) as a measure of the stationarity of said background sounds; and (b3) determining whether the estimated variation obtained in step (b2) exceeds a predetermined stationarity limit $\gamma$.

14. The method of claim 13, further comprising estimating an energy $E(T_i)$ of said background sounds in each time sub window $T_i$ in step (b1).

15. The method of claim 14, wherein said estimated variation is formed in accordance with the formula:

$$V_T = \frac{\max_{T_i \in T} E(T_i)}{\min_{T_i \in T} E(T_i)}$$

16. The method of claim 15, further comprising overlapping time sub windows $T_i$ collectively covering said time window T.

17. The method of claim 16, further comprising equal size time sub windows $T_i$.

18. The method of claim 17, wherein each time sub window $T_i$ comprises two consecutive speech frames.

19. The method of claim 14, wherein said estimated variation is formed in accordance with the formula:

$$V_T = \frac{\max_{T_i \in \mathrm{MAXBUF}} E(T_i)}{\min_{T_i \in \mathrm{MINBUF}} E(T_i)}$$

where MAXBUF is a buffer containing only the largest recent energy estimates and MINBUF is a buffer containing only the smallest recent energy setimates.

20. An apparatus for encoding and/or decoding stationary background sounds in a digital frame based speech coder and/or decoder including a signal source connected to a filter, said filter being defined by a set of filter parameters for each frame, for reproducing the signal that is to be encoded and/or decoded, said apparatus comprising:

(a) means for detecting whether the signal that is directed to said encoder/decoder represents primarily speech or background sounds;

(b) means for detecting, when said signal directed to said encoder/decoder represents primarily background sounds, whether said background sound is stationary; and (c) means for restricting a temporal variation between consecutive frames and/or the domain of at least some filter parameters in said set of filter parameters when said signal directed to said encoder/decoder represents stationary background sounds.

21. The apparatus of claim 20, wherein said stationarity detection means comprises:

(b1) means for estimating a statistical moment of said background sounds in each of N time sub windows $T_i$, where N>2, of a time window T of predetermined length;

(b2) means for estimating a variation of the estimates as a measure of the stationarity of said background sounds; and (b3) means for determining whether the estimated variation exceeds a predetermined stationarity limit $\gamma$.

22. The apparatus of claim 21, comprising means for estimating an energy $E(T_i)$ of said background sounds in each time sub window $T_i$.

23. The apparatus of claim 22, wherein said estimated variation is formed in accordance with the formula:

$$V_T = \frac{\max_{T_i \in T} E(T_i)}{\min_{T_i \in T} E(T_i)}$$

24. The apparatus of claim 22, further comprising means for controlling a first buffer MAXBUF and a second buffer MINBUF to store only recent large and small energy estimates, respectively.

25. The apparatus of claim 24, wherein each of said buffers MINBUF, MAXBUF stores, in addition to energy estimates, labels identifying the time sub window $T_i$ that corresponds to each energy estimate in each buffer.

26. The apparatus of claim 25, wherein said estimated variation is formed in accordance with the formula:

$$V'_T = \frac{\max_{T_i \in \mathrm{MAXBUF}} E(T_i)}{\min_{T_i \in \mathrm{MINBUF}} E(T_i)}$$

* * * * *